US005465464A

United States Patent [19]

Chen et al.

[11] Patent Number: 5,465,464

[45] Date of Patent: Nov. 14, 1995

[54] DECORTICATING MACHINE WITH VARIABLE SPEED FEED AND BEATER ROLLERS

[75] Inventors: Lung-Hua Chen, Rancho Palos Verdes, Calif.; Jonathan Pote; Marty Fuller, both of Starkville, Miss.

[73] Assignee: Mississippi State University, Mississippi State, Miss.

[21] Appl. No.: 261,978

[22] Filed: Jun. 17, 1994

[51] Int. Cl.[6] ..... D01B 1/22

[52] U.S. Cl. ..... 19/24

[58] Field of Search ..... 19/5 A, 5 R, 10, 19/24, 28, 30, 33, 34; 241/7, 14, 24, 28, 189, 155, 236; 162/20

[56] References Cited

U.S. PATENT DOCUMENTS

| | | | |
|---|---|---|---|
| 420,575 | 2/1890 | Hartshorn | 19/5 A |
| 1,308,376 | 7/1919 | Schlichten | 19/5 A |
| 1,722,110 | 7/1929 | Pritchard | 19/24 |
| 2,356,000 | 8/1944 | Patterson | 19/24 X |
| 2,747,232 | 5/1956 | Armstrong | 19/5 R X |

FOREIGN PATENT DOCUMENTS

| | | | |
|---|---|---|---|
| 0747912 | 7/1980 | U.S.S.R. | 19/5 R |
| 2205865 | 6/1987 | United Kingdom | 19/24 |

*Primary Examiner*—Clifford D. Crowder
*Assistant Examiner*—Ismael Izaguirre
*Attorney, Agent, or Firm*—Oblon, Spivak, McClelland, Maier & Neustadt

[57] ABSTRACT

A decortication machine for loosening and separating the core of kenaf or similar stalks from the outer fiber. The machine includes first and second sets of bladed feed rollers which have blades which intermesh to crush and split the bast fiber bark longitudinally and breakup the core of the stalks into short segments. The stalks are then fed into a first set of bladed beater rollers which have blades which intermesh to beat against the bast fiber and loosen and separate the broken core pieces. The machine includes a third set of bladed feed rollers downstream from the first set of bladed beater rollers. The third set of feed rollers further breaks up any remaining core pieces associated with the bast fibers and feed the stalks into a second set of bladed beater rollers. The blades of the second set of bladed beater rollers also intermesh to beat against the fibers and further loosen and separate additional core pieces. The stalks are then fed through a fourth set of bladed feed rollers which further break any core pieces that may remain. The feed rollers are most preferably driven at a linear speed of about 9.2 to about 10.4 feet per second. One roller of each pair of bladed beater rollers is most preferably driven at a linear speed of about 13.1 to about 14.8 feet per second and the other at a linear speed of about 15.7 to about 17.8 feet per second.

8 Claims, 4 Drawing Sheets

DECORTICATING MACHINE WITH VARIABLE SPEED FEED AND BEATER ROLLERS

BACKGROUND OF THE INVENTION

1. Field of the Invention

The present invention relates to a machine designed to decorticate, i.e. separate, the bast fibers comprising the outer bark of kenaf, jute, or similar stalks from the inner core thereof with minimum damage to the bast fibers. In particular, the invention relates to a unique arrangement and operating speed of sets of feed rollers which crush and split the bast fiber longitudinally and break the core into short segments, and beater rollers to loosen and separate the core pieces from the bast fibers.

2. Discussion of the Background

A decorticating machine is described in U.S. Pat. No. 2,719,332 which includes feed rollers adapted to feed the stalks toward a backing plate which has a surface which cooperates with the sharp edges on the blades or fins of a beater roller to cause the cores of the stalks to disintegrate. One or more additional beater rollers are provided for beating the stalks to remove the broken core pieces and other undesirable material. Another decorticating apparatus is described in U.S. Pat. No. 442,735. The apparatus disclosed in the '735 patent includes a plurality of feed rollers some of which are smooth and some of which are corrugated. A knife is positioned at the output side of the most downstream set of feed rollers to split the stalk longitudinally and direct one half of the split stalk to one set of beater rollers and the other half of the stalk to another set of beater rollers. In both the '332 and '735 patents, the rollers used for beating the stalks to remove the broken core pieces are driven at a higher speed than the feed rollers. Neither of said patents provides for additional sets of feed rollers to further crush the stalks and break up the core pieces after the stalks pass through a set of beater rolls nor does either patent provide for driving the upper roll of a set of beater rolls at a different speed than the lower beater roll. In addition, there is no discussion in either patent with respect to the rotational or linear (i.e., tangential) speed at which any of the rollers should be driven or that there is any correlation between the speed of operation of the various rollers and the amount of core which is removed from the bast fibers as the stalks pass through the machine.

SUMMARY OF THE INVENTION

It is an object of the present invention to provide a plurality of stages of crushing or crimping and brushing or beating the stalks in order to more effectively remove the core pieces from the bast fiber.

It is another object of the present invention to not only drive the beater rollers at a higher linear (i.e., tangential) speed than the crimping rollers but to drive each beater roller of a pair at a different linear (i.e., tangential) speed and thereby more effectively remove the core pieces from the bast fiber.

It is a further object of the present invention to operate the crimping rollers and the beater rollers in a preferred speed range in order to more efficiently remove the core pieces from the bast fiber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DESCRIPTION OF THE PREFERRED EMBODIMENTS

Figure 1:
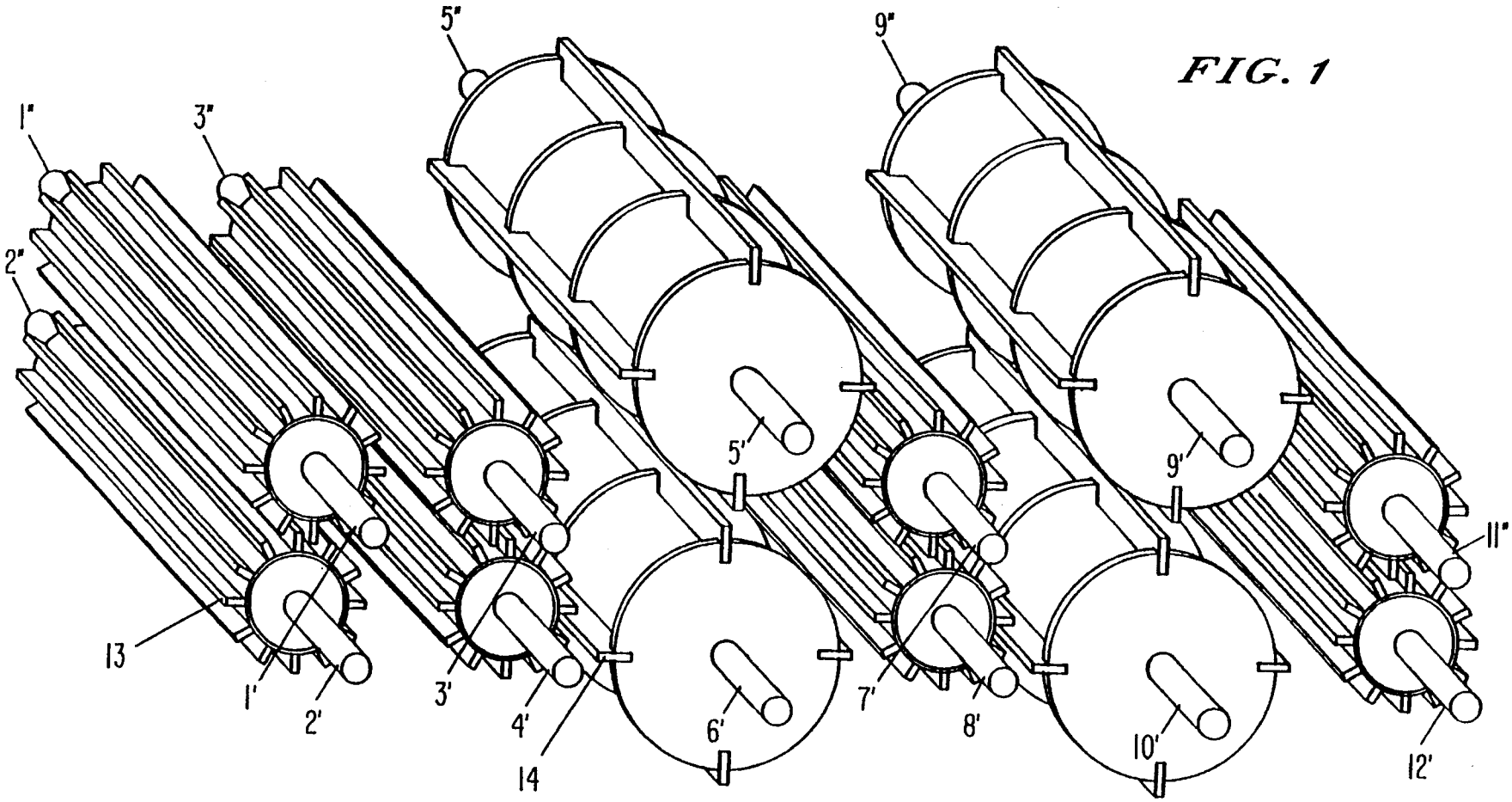
FIG. 1 is a perspective view of the feed rollers used to crimp the stalks and the beater rollers used to beat the stalks.
Figure 2:
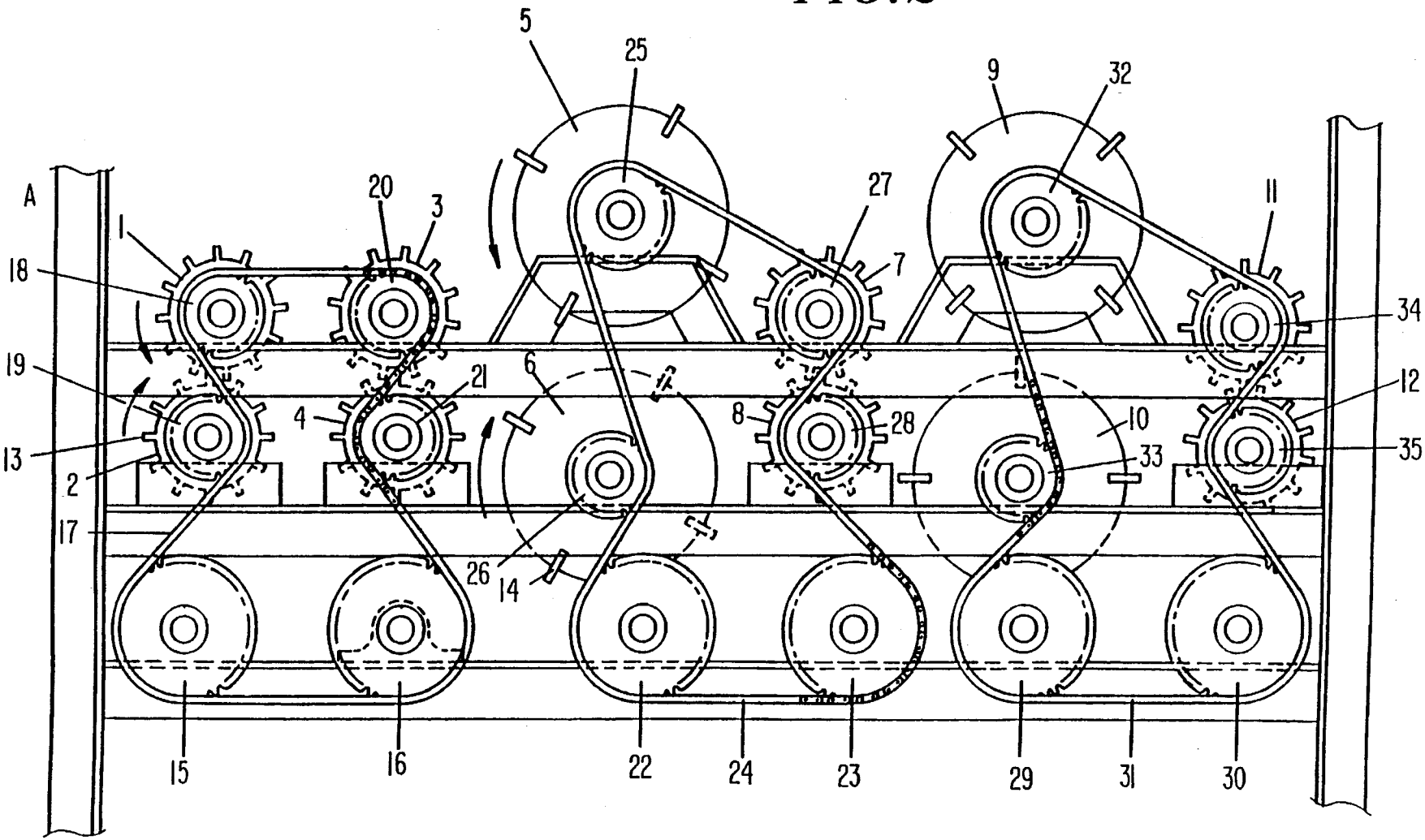
FIG. 2 is a side view showing the drive chains used to drive the rollers used in various stages of the machine.
Figure 3:
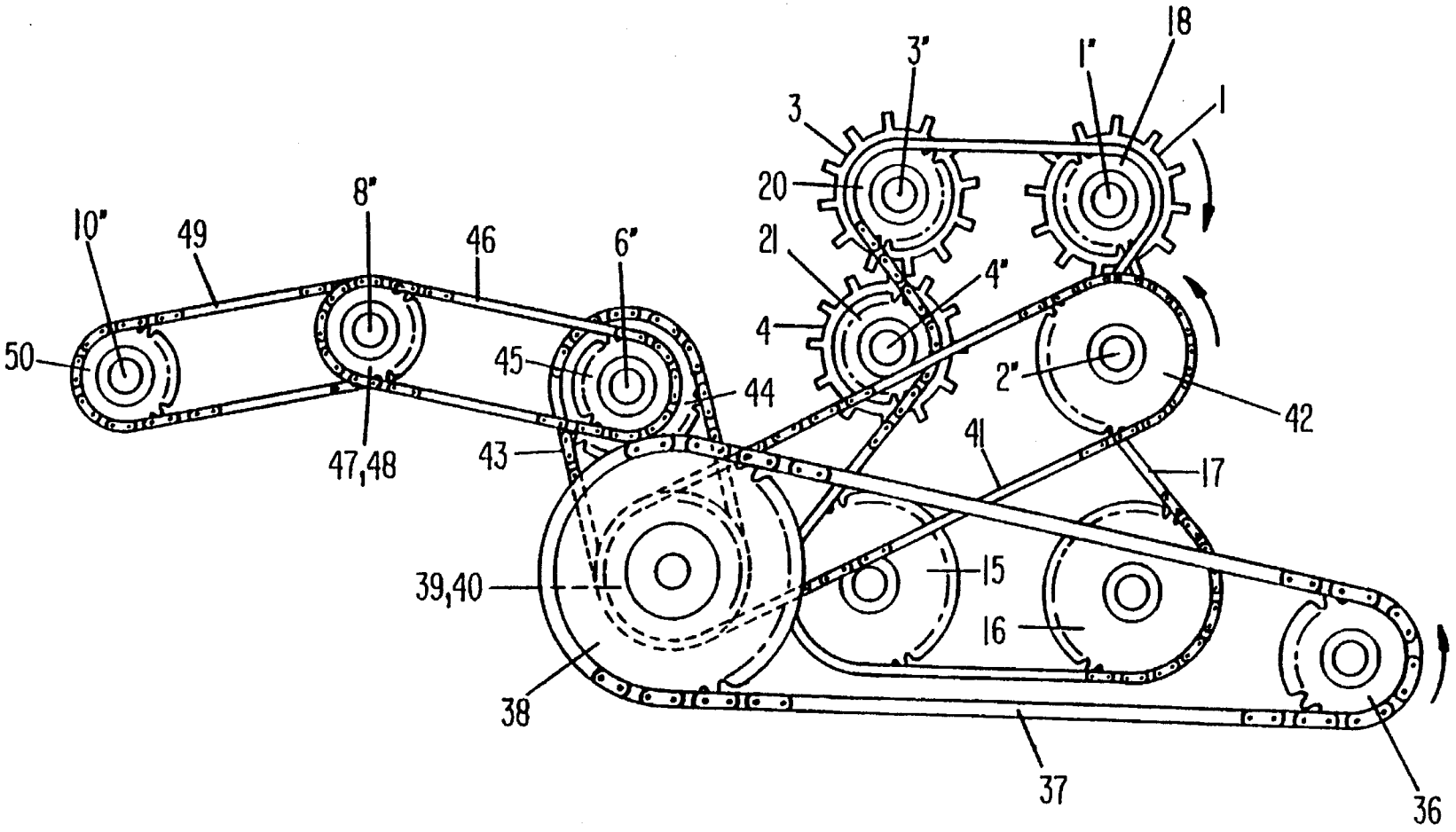
FIG. 3 is a view of the machine from the side opposite to that shown in FIG. 2 and further illustrates the chain drive used to operate the apparatus.

FIG. 1 illustrates a first set of feed rollers 1, 2, a second set of feed rollers 3, 4, a first set of beater rollers 5, 6, a third set of feed rollers 7, 8, a second set of beater rollers 9, 10, and a fourth set of feed rollers 11, 12. The feed roller 1 has a stub shaft 1' at one end thereof and a stub shaft 1" at the opposite end thereof as illustrated in FIG. 1. The feed roller 2, 3, 4, 7, 8, 11, and 12 are likewise provided with stub shafts at the opposite ends thereof. The stub shafts which are illustrated in FIG. 3 include 2', 2", 3', 3", 4', 7', 8', 11', and 12'. The beater rollers 5, 6, 9, and 10 are likewise provided with stub shafts at the opposite ends thereof. The stub shafts illustrated in FIG. 1 include 5', 5", 6', 9', 9", and 10'. The stub shafts serve to mount the rollers in the machine frame A and receive drive sprockets which engage drive chains as illustrated in FIGS. 2 and 3. Each feed roller is provided with a plurality of blades 13 having curved edges. The blades on the upper roller 1 co-act with the blades on the lower roller 2 to crimp kenaf or similar stalks so as to break the core into short segments without damaging the bast fibers. By using curved blades on the rollers, it is possible to break the core of the stalks into short segments without damaging the bast fibers.

The set of feed rollers 3 and 4 immediately follow the feed rollers 1 and 2 and also crimp the stalks to further increase the breakage of the core. The set of feed rollers 3 and 4 is followed by a set of beater rollers 5 and 6 which are provided with fins 14 positioned to beat against the centers of the stalks fed thereinto by the feed rollers 3 and 4 to loosen and separate broken core pieces from the bast fiber.

The broken core pieces fall by gravity past the lower beater roller to the ground or other supporting surface on which the apparatus is resting. The stalks continue to be fed through the next set of feed rollers 7 and 8 where any remaining core pieces are further disintegrated. The stalks continue through the feed rollers 7 and 8 into a second set of beater rollers 9 and 10 which further loosen and separate additional core pieces, which again fall by gravity past the lower beater roller 10 to the ground or other supporting surface. The stalks continue to be fed from the beater rollers 9 and 10 through a fourth set of feed rollers 11 and 12, which further crimp any remaining core pieces thereby permitting them to be more easily removed during further processing.

The momentum given to the stalks by the first set of feed rollers 1, 2 delivers the stalks to the second set of feed rollers 3 and 4 which in turn deliver the stalks to the beater rollers 5 and 6. This action continues with succeeding sets of rollers until the stalks pass out of the machine through the fourth set of feed rollers 11 and 12.

The first two sets of feed rollers 1, 2 and 3, 4 as well as idler's sprockets 15 and 16 are driven by the chain 17. The beater rollers 5 and 6 and the third set of feed rollers 7 and 8 as well as idler sprockets 22 and 23 are driven by the chain 24. The second set of beater rollers 9 and 10 and the fourth set of feed rollers 11 and 12 as well as idler sprockets 29 and 30 are driven by the chain 31. The chain drives 17, 24, and 31 are illustrated in FIG. 2.

Drive sprockets 18, 19, 20, and 21 are provided on feed rollers 1, 2, 3, and 4, respectively. The sprockets 18, 19, 20, and 21 are the same size and therefore cause the rollers 1, 2, 3, and 4 to rotate at the same angular velocity. The rollers therefore maintain close control of fiber movement and minimize any potential damage to the bast fiber by pulling between the two sets of rollers.

The beater roller 5 has a drive sprocket 25 and the beater roller 6 has a drive sprocket 26. The drive sprocket 26 on the beater roller 6 is smaller than the drive sprocket 25 on the beater roller 5 so that the beater roller 6 rotates at a higher linear (i.e., tangential) speed than beater roller 5. The difference in linear (i.e., tangential) speed between the beater rollers 5 and 6 enhances their ability to loosen and separate the broken core pieces from the bast fiber. Of course, the sprocket arrangement could be reversed on rollers 5 and 6 so that beater roller 6 rotates at a lower speed than beater roller 5.

The feed rollers 7 and 8 have drive sprockets 27 and 28, respectively. Beater rollers 9 and 10 correspond to beater rollers 5 and 6 in that beater roller 9 has a drive sprocket 32 which is larger than the drive sprocket 33 on beater roller 10 so that beater roller 10 operates at a higher linear (i.e., tangential) speed than beater roller 9. Again, the sprocket arrangement on beater rollers 9 and 10 could be reversed, if desired. As with beater rollers 5 and 6, the difference in linear (i.e., tangential) speed between the beater rollers 9 and 10 enhances their ability to loosen and remove core pieces from the bast fibers, which still remain after the first beating stage. The final set of feed rollers 11 and 12 are provided with drive sprockets 34 and 35, respectively.

The main drive chains are illustrated in FIG. 3. Drive sprocket 36 is connected to a source of external power such as the power take off shaft of a tractor. The drive sprocket 36 drives the chain 37 which in turn drives the large sprocket 38. Sprockets 39 and 40 are co-axially mounted on the same shaft with sprocket 38. The sprocket 39 drives chain 41 which in turn drives sprocket 42 mounted on the shaft of feed roller 2. Therefore, feed rollers 1, 2, 3, and 4 are driven through the power input provided at sprocket 42.

As shown in FIG. 3, the sprocket 36 is driven in a counter-clockwise direction which results through the various chain drives in rotation of the upper feed rollers 1 and 3 in a clockwise direction and the lower feed rollers 2 and 4 in a counter-clockwise direction.

The sprocket 40 drives chain 43 which in turn drives sprocket 44 on stub shaft 6". Sprocket 45 is co-axially mounted with sprocket 44 and drives the chain 46 which in turn drives sprocket 47 on stub shaft 8". Sprocket 48 is coaxially mounted on the same shaft with sprocket 47 and drives chain 49 which in turn drives sprocket 50 on stub shaft 10".

It has been found that the preferred operating speed for the feed rollers is between 200 and 305 rpm which translates to a linear (i.e., tangential) speed of 208 to 317 cm/sec. (6.82 to 10.4 ft./sec.) for the feed rollers which were used in testing the invention. The linear (i.e., tangential) speed of the beater rollers was faster than that of the feed rollers and ranged from 296 to 451 cm./sec. (9.7 to 14.8 ft. sec.) for the top beater roller and from 354 to 543 cm./sec. (11.6 to 17.8 ft./sec.) for the bottom beater roller. The relationship between rpm and the linear (i.e., tangential) speed of the feed rollers and the beater rollers is set forth in Table I below.

TABLE I

| | Linear (i.e., tansential) Speed (ft/s); (cm/s) | | |
|---|---|---|---|
| | | Beater Rollers | |
| Roller rpm | Feed Roller | Top | Bottom |
| 200 | 6.8; 207 | 9.7; 296 | 11.6; 354 |
| 235 | 8.0, 244 | 11.4; 347 | 13.7; 418 |
| 252 | 8.6, 262 | 12.2; 372 | 14.7; 448 |
| 270 | 9.2; 280 | 13.1; 399 | 15.7; 479 |
| 288 | 9.9; 302 | 14.0; 427 | 16.8; 512 |
| 305 | 10.4; 371 | 14.8; 451 | 17.8; 543 |

Figure 4:
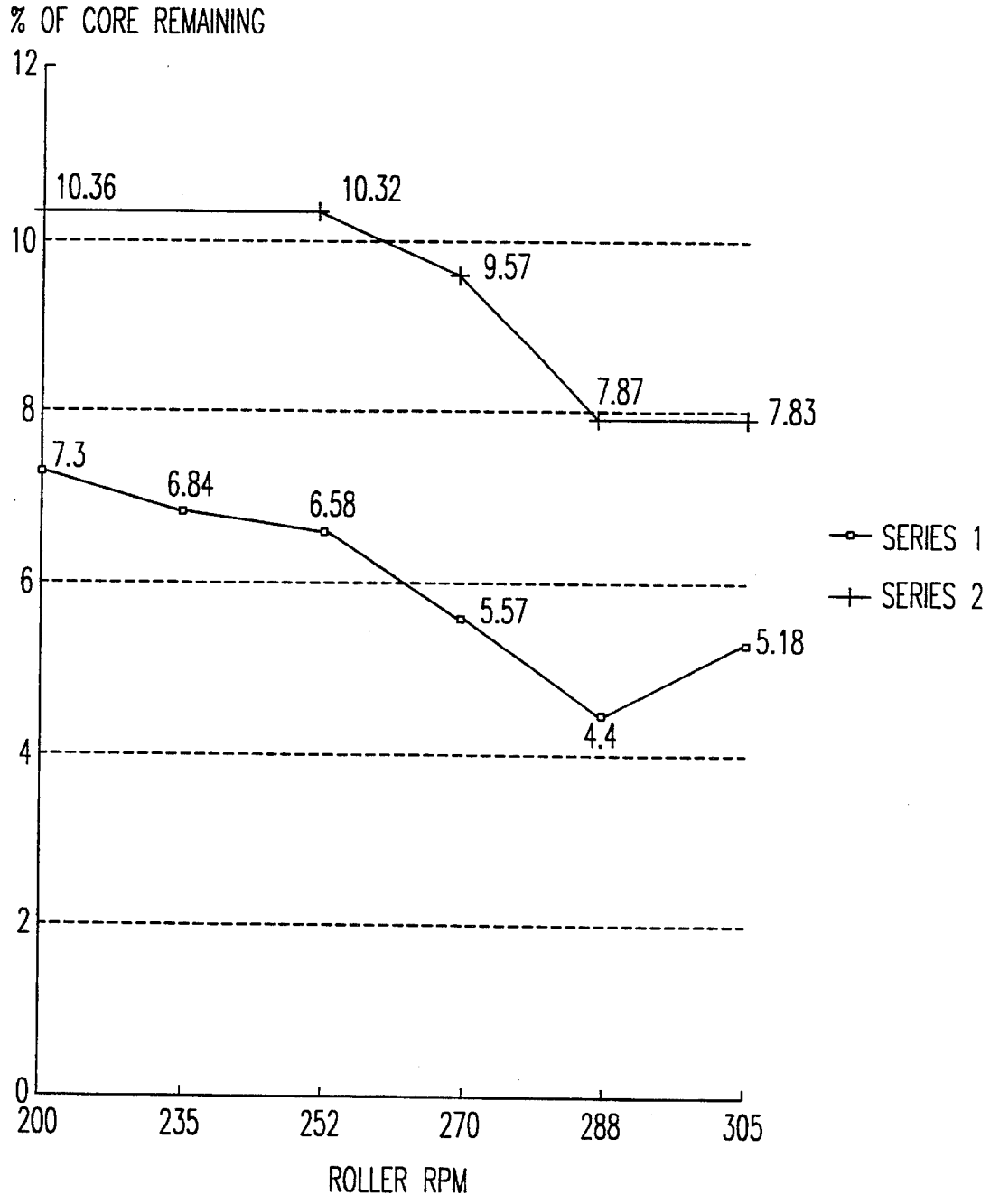
FIG. 4 is a graph illustrating the percentage of core remaining with the fibers after the stalks pass through the machine in relationship to the roller rpm.

The tests also show that there is a relationship between the roller rpm and the percentage of core remaining with the fiber. As shown in Table II below, the percentage of core remaining with the fiber decreases with increased rpm from about 200 rpm up to about 305 rpm. The preferred roller rpm is in the range of about 270 to about 305. The data was gathered while harvesting kenaf stalks at approximately one acre per hour. The stalks used in Test (Series) 1 of Table II had an average diameter of 1.42 cm. (0.56 inch) and the stalks used in Test (Series) 2 of Table II had an average diameter of 1.90 cm. (0.75 inch). The core moisture content of the stalks used for Test 1 was 60.84% and the core moisture content of the stalks used for Test 2 was 65.83%. The stalks used in Test 2 were decorticated one week after harvest. The data for Tests 1 and 2 of Table II are plotted on the graph illustrated in FIG. 4. The graph clearly illustrates the correlation between the percent of core remaining with the bast fiber and roller rpm.

TABLE II

| | Percent of Core Remaining with Bast Fiber | |
|---|---|---|
| Roller rpm | Test 1 | Test 2 |
| 200 | 7.3 | 10.4 |
| 235 | 6.8 | missing |
| 252 | 6.6 | 10.3 |
| 270 | 5.6 | 9.6 |
| 288 | 4.4 | 7.9 |
| 305 | 5.2 | 7.8 |

Thus, with the disclosed invention, which provides a stalk flow path including two sets of feed rollers followed by alternating sets of beater rolls and feed rollers, the core pieces are more thoroughly removed from the bast fiber of kenaf or similar stalks than has been possible prior to the present invention. The bast fibers may thus be more quickly processed during subsequent treatments than has been possible with prior art decorticating machines.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A decortication machine for feeding stalks along a path of travel and separating the outer bast fibers of the stalks from the inner core thereof, comprising:

(a) a first set of bladed feed rollers for feeding the stalks, the blades of said first set of feed rollers intermeshing to crush the stalks and break the cores into short segments without breaking the bast fibers;

(b) a second set of bladed feed rollers positioned downstream of said first set of bladed feed rollers receiving the stalks from the first set of bladed feed rollers, the blades of said second set of bladed feed rollers intermeshing to further crush and split said stalks and further break up the inner core without breaking the bast fibers;

(c) a first set of bladed beater rollers positioned downstream of said second set of bladed feed rollers receiving the stalks from said second set of bladed feed rollers, the blades of said first set of bladed beater rollers beating alternately against the upper and lower outer surfaces of the stalks as the stalks pass therethrough to loosen and remove broken core pieces from the bast fibers;

(d) a third set of bladed feed rollers positioned downstream of said first set of bladed beater roller receiving the stalks from said first set of bladed beater rollers, the blades of said third set of bladed feed rollers intermeshing to break up core pieces remaining in the stalks after they pass through the first set of bladed beater rollers without breaking the bast fibers thereby facilitating removal of remaining core pieces from the bast fibers during subsequent processing;

(e) a second set of bladed beater rollers positioned downstream of said third set of bladed feed rollers, the blades of said second set of bladed beater rollers beating alternately against the upper and lower surfaces of the stalks to further loosen and remove broken core pieces, each roller of each of said sets of first, second, and third bladed feed rollers and each roller of each of said sets of first and second bladed beater rollers has a longitudinal axis extending perpendicular to said path of travel, the blades of each roller of said first, second, and third sets of bladed feed rollers and said first and second sets of bladed beater rollers extend radially outwardly with respect to the longitudinal axis of the respective roller, each of said blades has opposing longitudinally extending sides extending parallel to each other and an outer edge extending parallel to the longitudinal axis of the respective roller;

(f) means adapted to be connected to a prime mover for driving said first, second, and third sets of bladed feed rollers at the same tangential speed, driving said first and second sets of bladed beater rollers at a higher tangential speed than said first and second sets of bladed feed rollers and further driving one roller of each of said first sets of bladed beater rollers at a higher tangential speed than the other bladed beater roller of the respective set.

2. A decortication machine according to claim 1, further comprising a fourth set of bladed feed rollers positioned downstream of said second set of bladed beater rollers, each roller of said fourth set of bladed feed rollers has a longitudinal axis perpendicular to said path of travel, the blades of each roller of said fourth set of bladed feed rollers extend radially outwardly with respect to the longitudinal axis of the respective roller with each of said blades having opposing longitudinal sides extending parallel to each other and an outer edge extending parallel to the longitudinal axis of the respective roller, the blades on the fourth set of bladed feed rollers intermeshing to further break up remaining core pieces in the stalks without breaking the bast fibers to thereby further facilitate removal of the remaining core pieces in subsequent processing.

3. A decortication machine according to claim 2, wherein said first, second, third, and fourth sets of bladed feed rollers are driven at the same tangential speed of about 208 to about 317 cm./sec. (6.8 to about 10.4 ft./sec.), one of the rollers of each set of said first and second sets of bladed beater rollers is driven at a tangential speed of about 296 to about 451 cm./sec. (9.7 to about 14.8 ft./sec.) and the other roller of each of said first and second sets of bladed beater rollers is driven at a tangential speed of about 354 to about 543 cm./sec. (11.6 to about 17.8 ft./sec.).

4. A decortication machine according to claim 3 wherein said first, second, third, and fourth sets of bladed feed rollers are driven at a tangential speed of about 280 to about 317 cm./sec. (9.2 to about 10.4 ft./sec.), one of the rollers of each set of said first and second sets of bladed beater rollers is driven at a tangential speed of about 399 to about 451 cm./sec. (13.1 to about 14.8 ft./sec.) and the other roller of said first and second sets of bladed beater rollers is driven at a tangential speed of about 479 to about 543 cm./sec. (15.7 to about 17.8 ft./sec.).

5. A method of decorticating stalks to separate the outer bast fibers from the inner core thereof, comprising the steps of:

(a) feeding said stalks along a path of travel through a first set of intermeshing bladed feed rollers, the blades of said first set of bladed feed rollers crushing the stalks and breaking the cores into short segments without breaking the bast fibers;

(b) feeding said stalks through a second set of intermeshing bladed feed rollers positioned downstream of said first set of intermeshing bladed feed rollers which receive said stalks from the first set of intermeshing bladed feed rollers, the blades of said second set of intermeshing bladed feed rollers further crushing the stalks and further breaking up the inner core without breaking the bast fibers;

(c) feeding said stalk through a first set of bladed beater rollers positioned downstream of said second set of intermeshing bladed feed rollers which receive the stalks from said second set of intermeshing bladed feed rollers, the blades of said first set of bladed beater rollers beating alternately against the upper and lower outer surfaces of the stalks as the stalks pass therethrough thereby loosening and removing broken core pieces from the bast fibers;

(d) feeding said stalks through a third set of intermeshing bladed feed rollers positioned downstream of said first set of bladed beater rollers which receive the stalks from the first set of bladed beater rollers, the blades of said third set of intermeshing bladed feed rollers further breaking up core pieces remaining in the stalk after they pass through the first set of bladed beater rollers without breaking the bast fibers;

(e) feeding said stalks through a second set of bladed beater rollers positioned downstream of said third set of bladed feed rollers, the blades of said second set of bladed beater rollers alternately beating against the upper and lower outer surfaces of the stalks thereby further loosening and removing broken core pieces, each roller of each of said sets of first, second, and third bladed feed rollers and each roller of each of said sets of first and second bladed beater rollers has a longitudinal axis extending perpendicular to said path of travel, the blades of each roller of said first, second, and third sets of bladed feed rollers and said first and second sets of bladed beater rollers extend radially outwardly with respect to the longitudinal axis of the respective roller, each of said blades has opposing longitudinally extending sides extending parallel to each other and an outer edge extending parallel to the longitudinal axis of the respective roller;

(f) driving said first, second, and third sets of intermeshing bladed feed rollers at the same tangential speed and driving said first and second sets of bladed beater rollers at a higher tangential speed than said first, second, and third sets of intermeshing bladed feed rollers including driving one roller of each of said first and second sets of bladed beater rollers at a higher tangential speed than the other roller of each of said sets of bladed beater rollers.

6. A method of decorticating stalks according to claim 5, including feeding said stalks through a fourth set of intermeshing bladed feed rollers positioned downstream of said second set of bladed beater rollers, each roller of said fourth set of bladed feed rollers has a longitudinal axis perpendicular to said path of travel, the blades of each roller of said fourth set of bladed feed rollers extend radially outwardly with respect to the longitudinal axis of the respective roller with each of said blades having opposing longitudinal sides extending parallel to each other and an outer edge extending parallel to the longitudinal axis of the respective roller, the blades on said fourth set of intermeshing bladed feed roller further breaking remaining core pieces in the stalks without breaking the bast fibers to thereby further facilitate removal of the remaining core pieces in subsequent processing.

7. A method of decorticating stalks according to claim 6 including driving said first, second, third, and fourth sets of intermeshing bladed feed rollers at a tangential speed of about 208 to about 317 cm./sec. (6.8 to about 10.4 ft./sec.), driving one of the rollers of each set of said first and second sets of bladed beater rollers at a tangential speed of about 296 to about 317 cm./sec. (9.7 to about 14.8 ft./sec.) and driving the other roller of said first and second sets of bladed beater rollers at a tangential speed of about 364 to about 451 cm./sec (11.6 to about 17.8 ft./sec.).

8. A method of decorticating stalks according to claim 7, including driving said first, second, third, and fourth sets of bladed feed rollers at the same tangential speed of about 280 to about 317 cm./sec. (9.2 to about 10.4 ft./sec.) driving one of the rollers of each set of said first and second sets of bladed beater rollers at a tangential speed of about 399 to about 451 cm./sec. (13.1 to about 14.8 ft./sec.) and driving the other roller of said first and second sets of bladed beater rollers at a tangential speed of about 479 to about 543 cm./sec. (15.7 to about 17.8 ft./sec.).

* * * * *